United States Patent [19]

Johansson

[11] Patent Number: 4,844,439

[45] Date of Patent: Jul. 4, 1989

[54] RECEIVING DEVICE IN A SHEET CONVEYOR FOR OCCASIONAL COLLECTION OF SHEETS BEFORE CONTINUED CONVEYANCE

[75] Inventor: Bernt Johansson, Huddinge, Sweden

[73] Assignee: PMB Vector AB, Stockholm, Sweden

[21] Appl. No.: 185,464

[22] Filed: Apr. 25, 1988

[30] Foreign Application Priority Data

May 21, 1987 [SE] Sweden ..... 8702117

[51] Int. Cl.[4] ..... B65H 29/26

[52] U.S. Cl. ..... 271/192; 271/178; 271/218; 271/315

[58] Field of Search ..... 271/189, 192, 213–215, 271/217, 218, 178, 315

[56] References Cited

U.S. PATENT DOCUMENTS

| | | | |
|---|---|---|---|
| 1,637,170 | 7/1927 | Zuckerman | 271/315 X |
| 2,925,271 | 2/1960 | Faeber | 271/178 |
| 4,384,813 | 5/1983 | Smith | 271/192 X |

FOREIGN PATENT DOCUMENTS

| | | | |
|---|---|---|---|
| 2104494 | 3/1983 | United Kingdom | 271/178 |

*Primary Examiner*—Richard A. Schacher

*Attorney, Agent, or Firm*—Webb, Burden, Ziesenheim & Webb

[57] ABSTRACT

A receiving device in a sheet conveyor for collecting occasionally one or more sheets (20) to be conveyed thereafter further by a conveyor (11, 12, 13) for continued sheet handling disposed beneath the device comprises a first and a second guide wall (7) located above the conveyer (11–13) in a spaced relationship, said guide walls extending transversely of the conveying direction of the conveyer and at a mutual distance somewhat greater than the length in the conveying direction of the sheets to be received and collected. Movable sheet carrying rods (9) are arranged between the guide walls (7) and in the lower edge area of the respective guide wall. Besides, sheet depressing fingers (10) are arranged to engage the uppermost sheet of the sheets (20) located in the device and depress the pile of sheets downwards towards the conveyer after the sheet carrying rods (9) have been moved out of engagement beneath said sheets (20).

5 Claims, 2 Drawing Sheets

RECEIVING DEVICE IN A SHEET CONVEYOR FOR OCCASIONAL COLLECTION OF SHEETS BEFORE CONTINUED CONVEYANCE

This invention relates to a device in sheet conveyers for collecting occasionally one or more sheets to be conveyed thereafter further by a conveyer located beneath the device for continued sheet handling.

In distribution of printed material there is often a need of including several sheets with different information in the same posting—envelope —. This means in fully automatic sheet handling that such sheets are to be collected in batches before further conveyance takes place for a possible additional completion and/or enveloping. Normally the relative sheets are collected on the conveyer which moves intermittently or the sheets can be collected in the intended number and given off to the conveyer from another feeding device operating at an angle of 90° to the conveyer. In the previous case the handling rate is restricted and in the latter case the function risked due to the fact that a more or less big bundle of sheets is to be handled at the same time and momentarily change direction of motion 90°. It is then to be understood that the conveying rates are high.

Through the present invention given the characteristic features defined in the claims a reliable collection of sheets and a further conveyance thereof is obtained at the same time as the conveying rate can be kept high, and it is not necessary to stop the conveyer for continued sheet handling.

Figure 1:
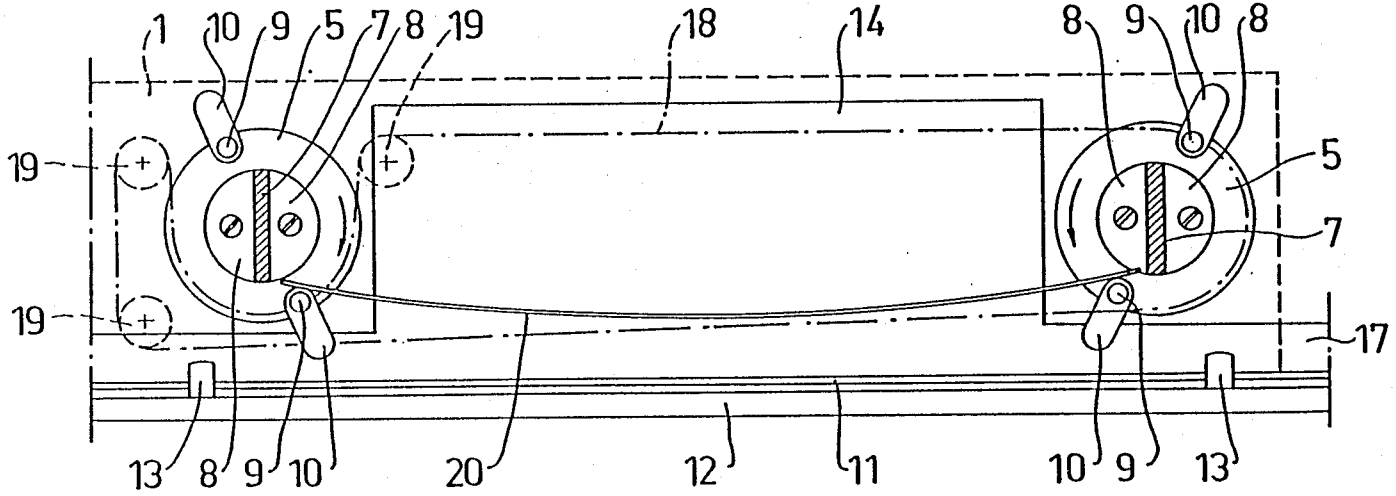
Figure 2:
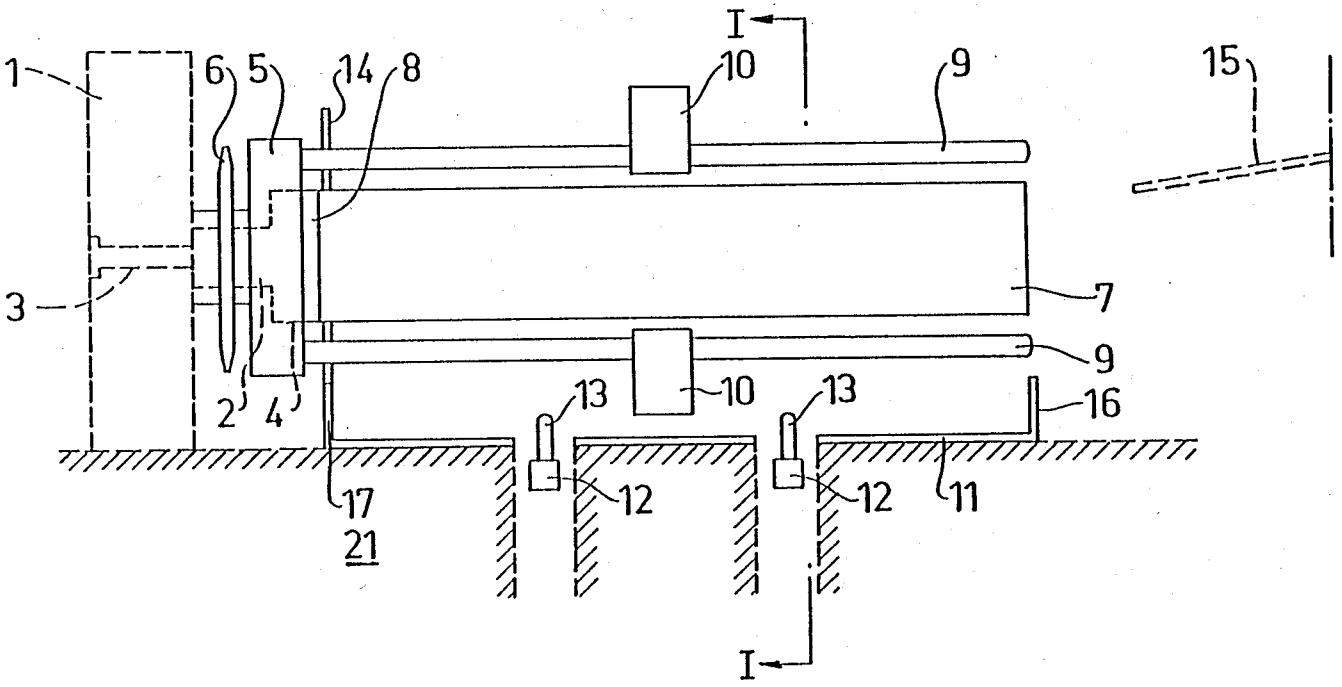

The invention will be described in greater detail in the form of examples with reference to the drawing, wherein FIG. 1 shows the invention as seen schematically in the directions of the arrows I—I in FIG. 2 and FIG. 2 shows the invention as seen schematically from one end.

In the FIGS. 1 designates schematically a stand of a suitable form in which two hubs 2 are attached in a suitable manner. In FIG. 2 the attachment is indicated to be made by means of a screw 3. The respective hub 2 is provided with a head or flange 4. A member or disc 5 is rotatably monted on the hub 2. The disc 5 which is axially immovable on the hub 2 further supports a chain wheel 6 stationary with the disc. At each hub 2 with its flange 4 a guide wall in the form of an elongated guide plate 7 is attached by means of flanges 8 extending from the guide plate. The attachment of the respective guide plate 7 to the hub 2 is shown as made by means of screws. Two rods 9 are attached to the rotatable disc 5 diagonally relative to one another which have a length corresponding to the width of the sheets to be handled. The respective rod 9 is attached to the disc 5 on a radius outside the edges of the guide plate 7. Each rod 9 supports a finger 10 directed radially outwards and fixed to the rod in a suitable manner. 11 designates a conveying track, the width of which is somewhat greater than the sheets to be handled. In the example (FIG. 2) a sheet conveyer is shown in the form of two chains 12 which have shoulders 13, the distance between adjacent shoulders on the same chain being greater than the length of the sheets to be handled. 14 designates a stop and guide plate which is intended to stop and direct the sheets fed to the device from a conveyer or feeder preceding the device and schematically indicated by 15. This feeder 15 can be of any type known per se and is not described here in detail. The conveying track 11 is further provided with a guide edge 16 intended to guide the papers along the conveying track. A corresponding guide edge 17 is also arranged on the opposite side of the conveyer track 11 as a continuation of the stop and guide plate 14. The two rotatable members or discs 5 are driven synchronously by a chain indicated by 18 running in engagement with the respective chain sheel 6. The two rotatable members 5 are to rotate in opposite directions and this is achieved in that the chain for instance is given an extension shown in FIG. 1 by the use of three pulleys indicated only schematically by 19.

One or more sheets are fed from the feeder 15 down onto the device of the invention, the discs 5 of which enter the positions shown in FIG. 1 together with rods 9 and fingers 10. The sheet or sheets—one sheet 20 is shown in FIG. 1—get their edge portions resting against the rods 9 located inside the guide plates 7, said rods serving as carrying means for the sheet or sheets 20. When a predetermined number of sheets, for example read by means of a photocell with counter (not shown), has been fed to the device an impulse is given to the drive motor of the chain 18 which will momentarily turn the two discs 5 synchronously half a revolution in the direction indicated by the arrows. This turning direction will cause the lower rods 9, on which the end parts of the sheets are resting, to move out of engagement with the sheets. At the same time the upper rods will be turned downwards entering the position of the other rods and ensure simultaneously with their fingers 10 that the sheets are depressed on the conveying track 11. It is to be understood that the rotary motion of the discs 5 is very fast and in principle the fingers 10 will strike down the sheets onto the conveying track 11 by a distinct movement. The bundle of sheets delivered there is conveyed further by means of the chain 12 and the shoulders 13. It will be easily appreciated that the chain with the shoulders can move unrestrictedly past the device beneath the sheets as long as the sheets are supported by the device in the position shown in FIG. 1.

Thus, it is possible by means of the invention to achieve a receiving device for sheets working very quickly, said device giving off these distinctly to a conveyer lying below for further conveyance, which conveyer can be operated intermittently or continuously depending on a following handling process.

21 designates schematically the foundation supporting the device (FIG. 2).

Of course the invention can be varied within the scope of the following claims with respect to design and construction of details and more than one finger can be arranged on the respective rod. The discs 5 can be driven in another way than that shown. It is also to be understood that the guide plate 7 can be attached directly to the rotatable disc 5 and turn together with this which, however, implies that a limited lot of sheets are collected in the device in order that the turning of the guide plates 7 might not influence the collected bundle in an unfavourable way. Despite the fact that this, thus, is a simpler construction the embodiment shown is to be preferred. It is also possible to arrange in a simple way so that the distance between the discs 5 is adjustable for adaptation to different sheet sizes.

I claim:

1. A receiving device in a sheet conveyer for collecting occasionally one or more sheets (20) to be conveyed thereafter further by a conveyer (11, 12, 13) for continued sheet handling, characterized in that the device comprises a first and second stationary guide wall (7)

disposed above the conveyer in a spaced relationship, said guide walls extending transversely of a conveying direction of the conveyer (11–13) and at a mutual distance somewhat greater than a length of the sheets (20) to be received and collected, a movable sheet carrying means (9) arranged between the guide walls (7) and in the lower edge area of the respective guide wall, said sheet carrying means including a pair of spaced-apart, rotatable elements for supporting a common sheet therebetween and sheet depressing means (10) arranged to engage an uppermost sheet of the sheets (20) located on the sheet carrying means and depress the pile of sheets downwards towards the conveyer (11–13) after the spaced pair of rotatable elements of the sheet carrying means (9) have been moved out of engagement beneath said sheets (20).

2. The device as claimed in claim 1, characterized in that the respective guide wall has the form of a guide plate (7) with a limited height, that the respective sheet carrying means (9) is attached to a member (5) rotatable about a shaft (2) through the centre of the guide plate and that the respective sheet depressing means (10) is attached to the rotatable member (5) diagonally relative to the sheet carrying means (9).

3. The device as claimed in claim 2, characterized in that the sheet carrying means is formed as a rod (9) having a length substantially corresponding to the width of the sheets (20) and that the sheet depressing means has the form of one or more fingers (10) directed radially outwards as seen from the shaft (2).

4. The device as claimed in claim 3, characterized in that the sheet carrying means (9) is provided with one or more of said fingers (10) and that a further sheet carrying means in the form of rod (9) is attached to the rotatable member (5) diagonally relative to the first rod (9) and supports one or more of said fingers (10), the respective rotatable member turning half a revolution for one sheet delivering cycle.

5. The device as claimed in claim 4, characterized in that two rods (9) are attached by their one ends diagonally relative to each other at the periphery of the rotatable member in the form of an intermittent rotatably operated disc (5), the centre of which is stationary and to which the guide plate (7) is attached.

* * * * *